US007721688B2

(12) United States Patent
Kamiyama

(10) Patent No.: US 7,721,688 B2
(45) Date of Patent: May 25, 2010

(54) VARIABLE COMPRESSION RATIO INTERNAL COMBUSTION ENGINE

(75) Inventor: Eiichi Kamiyama, Mishima (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 121 days.

(21) Appl. No.: 11/851,102

(22) Filed: Sep. 6, 2007

(65) Prior Publication Data

US 2008/0053420 A1 Mar. 6, 2008

(30) Foreign Application Priority Data

Sep. 6, 2006 (JP) ..... 2006-242150

(51) Int. Cl.
*F02B 75/04* (2006.01)

(52) U.S. Cl. ..... 123/78 R; 123/41.84; 123/48 R; 123/48 C; 123/78 C; 123/48 B

(58) Field of Classification Search ..... 123/48 R, 123/48 A, 48 AA, 48 B, 48 C, 48 D, 78 R, 123/78 D, 78 BA, 78 E, 78 F
See application file for complete search history.

(56) References Cited

U.S. PATENT DOCUMENTS 4,174,683 A * 11/1979 Vivian ..... 123/48 C
6,152,090 A * 11/2000 Fujimoto et al. ..... 123/41.74
6,880,499 B2 * 4/2005 Hoffmann et al. ..... 123/48 C
7,036,468 B2 * 5/2006 Kamiyama ..... 123/78 R
7,322,320 B2 * 1/2008 Sugano ..... 123/41.84
2004/0211374 A1 * 10/2004 Kamiyama ..... 123/78 R

FOREIGN PATENT DOCUMENTS

| | | |
|---|---|---|
| JP | 11-6462 | 1/1999 |
| JP | 2001-59450 | 3/2001 |
| JP | 2003-206771 | 7/2003 |
| JP | 2005-113839 | 4/2005 |
| JP | 2005-146891 | 6/2005 |

* cited by examiner

*Primary Examiner*—Michael Cuff
*Assistant Examiner*—Hung Q Nguyen
(74) *Attorney, Agent, or Firm*—Oblon, Spivak, McClelland, Maier & Neustadt, L.L.P.

(57) ABSTRACT

An internal combustion engine includes a variable compression ratio mechanism made up of a case-side bearing-forming portion, a block-side bearing-forming portion, and a shaft-shaped drive portion. The case-side bearing-forming portion is formed in an upper portion of a crankcase. The block-side bearing-forming portion extends outward from a lower end portion of an outer wall surface of the cylinder block. The block-side bearing-forming portion is linked to the case-side bearing-forming portion by the shaft-shaped drive portion. Slit-shaped stress reduction groove portions each having an opening in a region between the block-side bearing-forming portion and cylinder bores are formed in a lower surface of the cylinder block. Therefore, even when the block-side bearing-forming portion presses the outer wall surface, the stress reduction groove portions reduce the stress, so that the deformation of the wall surface of each cylinder bore can be restrained.

11 Claims, 13 Drawing Sheets

HIGH COMPRESSION RATIO

MIDDLE COMPRESSION RATIO

LOW COMPRESSION RATIO

VARIABLE COMPRESSION RATIO INTERNAL COMBUSTION ENGINE

INCORPORATION BY REFERENCE

The disclosure of Japanese Patent Application No. 2006-242150 filed on Sep. 6, 2006 including the specification, drawings and abstract is incorporated herein by reference in its entirety.

BACKGROUND OF THE INVENTION

1. Field of the Invention

The invention relates to a variable compression ratio internal combustion engine capable of changing the compression ratio that is the ratio of the maximum value to the minimum value of the volume of a combustion chamber that changes with the movement of the piston.

2. Description of the Related Art

Variable compression ratio internal combustion engines have been proposed which change the compression ratio by moving the cylinder block relative to the crankcase in the direction of an axis (center axis) of a cylinder bore (hereinafter, simply referred to also as "up-down direction"). For example, one of the variable compression ratio internal combustion engines has a cylinder block that is disposed so as to be relatively movable in the up-down direction with respect to a crankcase, and a variable compression ratio mechanism.

In the cylinder block, in-line arranged four cylinder bores are formed. A piston is housed in each cylinder bore. The pistons are linked to a crankshaft. The crankshaft is rotatably supported by the crankcase. Furthermore, the variable compression ratio internal combustion engine includes a cylinder head. The cylinder head is fixed to a top portion of the cylinder block.

The variable compression ratio mechanism includes a block-side bearing-forming portion, a case-side bearing-forming portion and a shaft-shaped drive portion.

The block-side bearing-forming portion is fixed to an outer wall surface (side wall surface) of the cylinder block so as to extend out from the outer wall surface in a region that contains an crankcase-side end portion of the outer wall surface (a lower end portion of the cylinder block).

The case-side bearing-forming portion is made up of an upstanding wall portion and a cap portion. The cap portion is fixed to the upstanding wall portion that is formed on an upper portion of the crankcase.

The shaft-shaped drive portion includes a plurality of eccentric cam portions, and is disposed so as to extend through a cylindrical bearing hole formed in the block-side bearing-forming portion, and a cylindrical bearing hole formed in the case-side bearing-forming portion. Then, the shaft-shaped drive portion is rotated about a predetermined axis by a driving device. At this time, the shaft-shaped drive portion rotates in contact with the surfaces that define the cylindrical bearing holes formed in the block-side bearing-forming portion and the case-side bearing-forming portion, and causes a shift in the direction of eccentricity. Thus, the cylinder block can be slid relative to the crankcase to the top dead center side. As a result, since the distance between the cylinder block and the crankcase becomes longer, the volume of the combustion chamber when the piston is at the top dead center (the minimum value of the volume of the combustion chamber) becomes larger, and therefore the compression ratio becomes lower. In this manner, according to the foregoing internal combustion engine, the compression ratio can be changed (e.g., see Japanese Patent Application Publication No. 2003-206771 (JP-A-2003-206771)).

When a mixture gas burns in a combustion chamber defined by a wall surface that defines the cylinder bore, a lower surface of the cylinder head, and a top surface of a piston, the pressure of the gas in the combustion chamber becomes very high. Due to this pressure, the lower surface of the cylinder head is pressed upward by the pressure in the combustion chamber, and the top surface of the piston is pressed downward by the same pressure. Therefore, a force in an upward direction is exerted on the cylinder block to which the cylinder head is fixed. On the other hand, a force in a downward direction is exerted on the crankcase that supports the crankshaft linked to the piston. As a result, a crankcase-side portion of the surface that defines the bearing hole of the block-side bearing-forming portion receives a force caused by the shaft-shaped drive portion 53, and is therefore pressed downward.

Since a cylinder head-side end portion of the cylinder block is fixed to the cylinder head as mentioned above, the rigidity of the cylinder head-side end portion of the cylinder block is relatively high. On the other hand, a crankcase-side end portion of the cylinder block has a relatively low rigidity since the portion is not fixed to the crankcase. Furthermore, since the force exerted on the bearing hole of the block-side bearing-forming portion acts at a position that is apart outward from the outer wall surface of the cylinder block to which the block-side bearing-forming portion is fixed, the force acts on the cylinder block as a force that tends to bend a lower end portion of the cylinder block inward (bending moment).

In other words, a pressing force in an inward direction of the cylinder block (pressing direction) is exerted on a region in the outer wall surface of the cylinder block to which the block-side bearing-forming portion is fixed. Due to this pressing force, the wall surface defining the cylinder bore deforms in an inward direction of the cylinder bore. As a result, there is possibility that the friction force between the wall surface defining the cylinder bore and the piston may increase, and the fuel economy may deteriorate, or that the amount of inflow of lubricating oil into the combustion chamber may increase leading to useless consumption of lubricating oil.

SUMMARY OF THE INVENTION

It is an object of the invention to provide a variable compression ratio internal combustion engine capable of preventing deformation of a wall surface that defines a cylinder bore.

A first aspect of the invention is a variable compression ratio internal combustion engine that includes: a cylinder block having a cylinder bore that is a cylindrical hole extending through the cylinder block in a predetermined bore center axis direction, and that houses a piston; a cylinder head fixed to the cylinder block so as to cover one of opening portions of the cylinder bore; a crankcase that is disposed at a side of the cylinder block opposite from the cylinder head, and that is movable relative to the cylinder block in the bore center axis direction, and that rotatably supports a crankshaft that is linked to the piston; and a variable compression ratio mechanism that changes a capacity of a combustion chamber defined by a bore wall surface that defines the cylinder bore, a head lower surface that is a cylinder block-side surface of the cylinder head, and a piston top surface that is a head lower surface-side surface of the piston.

The variable compression ratio mechanism includes a block-side force-receiving portion extending outward from an outer wall surface of the cylinder block, and a linkage portion that changes a distance between the block-side force-receiving portion and the crankcase in the bore center axis direction while contacting each of the block-side force-receiving portion and the crankcase.

In the variable compression ratio internal combustion engine in accordance with this aspect, the cylinder block has a deformation-suppressing structure that restrains a deformation of the wall surface of the cylinder bore caused by a bore wall surface stress that occurs in the bore wall surface at a position of intersection between the bore wall surface and a pressing straight line that passes through a predetermined pressing position and that is a straight line parallel to a predetermined pressing direction as the block-side force-receiving portion receives by the linkage portion a force in a direction from the cylinder block toward the crankcase so that the block-side force-receiving portion presses the outer wall surface at the pressing position in the pressing direction.

Furthermore, in this aspect, the deformation-suppressing structure may be made up of a stress-reducing portion that makes the bore wall surface stress smaller than an outer wall surface stress that occurs in the outer wall surface at the predetermined pressing position as the block-side force-receiving portion receives by the linkage portion a force in a direction from the cylinder block toward the so that the block-side force-receiving portion presses the outer wall surface at the pressing position in the pressing direction.

That is, in the internal combustion engine in accordance with this aspect, as a mixture gas burns in the combustion chamber, a force in a direction from the cylinder block toward the cylinder head (upward direction) is exerted on the cylinder head, and a force in a direction from the piston toward the crankshaft (downward direction) is exerted on the piston. As a result, the block-side force-receiving portion is pulled in the downward direction by the crankcase via the linkage portion, and therefore the block-side force-receiving portion presses the outer wall surface in a predetermined pressing direction at a predetermined pressing position in the outer wall surface. Therefore, stress occurs in the cylinder block. Of this stress, the stress that occurs in the bore wall surface at a position of intersection between the bore wall surface and a straight line that passes through the pressing position and that is parallel to the pressing direction (bore wall surface stress) is made smaller than the stress that occurs in the outer wall surface at the pressing position (outer wall surface stress) by the stress-reducing portion.

Therefore, the degree of the deformation of the bore wall surface caused by the bore wall surface stress can be made smaller than in the case where a stress-reducing portion is not provided. As a result, the friction force between the bore wall surface and the piston does not become excessively large, so that deterioration in fuel economy can be prevented. Besides, the amount of lubricating oil that flows into the combustion chamber does not become excessively large, so that useless consumption of lubricating oil can be prevented.

In this aspect, the stress-reducing portion may be a slit-shaped groove portion that is formed in the cylinder block so as to have an opening at a position that is located between the block-side force-receiving portion and the bore wall surface in a crankcase-side surface of the cylinder block when the crankcase-side surface is viewed in the bore center axis direction.

According to this construction, when the block-side force-receiving portion presses the outer wall surface of the cylinder block as described above, a stress having substantially the same magnitude as the outer wall surface stress occurs in a portion of the cylinder block that is on the outer wall surface side of the groove portion (outer wall surface-side portion of the cylinder block), and the outer wall surface-side portion deforms. Therefore, the outer wall surface-side portion generates a force that opposes the force (pressing force) by which the block-side force-receiving portion presses the outer wall surface. As a result, the stress transmitted to a portion of the cylinder block that is on the bore wall surface side of the groove portion (bore wall surface-side portion) becomes smaller than the outer wall surface stress. Therefore, the aforementioned bore wall surface stress becomes smaller than in the case where the groove portion is not formed. As a result, the degree of the deformation of the bore wall surface caused by the bore wall surface stress can be made small.

If the cylinder block includes a hollow cylindrical cylinder liner that has an inner wall surface that constitutes the bore wall surface, the stress-reducing portion may be made up of a reinforcement member that has a higher rigidity than a portion of the cylinder block excluding the cylinder liner, and that is disposed in the cylinder block so as to extend through a position that is on the aforementioned pressing straight line and that is between the block-side force-receiving portion and the cylinder liner, and so as to surround a periphery of the cylinder liner about the bore center axis.

According to this construction, when the block-side force-receiving portion presses the outer wall surface of the cylinder block as described above, a stress having substantially the same magnitude as the outer wall surface stress occurs in a portion of the cylinder block that is on the outer wall surface side of the reinforcement member (outer wall surface-side portion of the cylinder block). At this time, since the rigidity of the reinforcement member is higher than the rigidity of the cylinder block, the rigidity of the reinforcement member makes the stress transmitted to a portion of the cylinder block on the bore wall surface side of the reinforcement member (bore wall surface-side portion) smaller than the outer wall surface stress. Therefore, the bore wall surface stress becomes smaller than in the case where the reinforcement member is not provided. As a result, the degree of the deformation of the bore wall surface (the cylinder liner) by the bore wall surface stress can be made small.

A variable compression ratio internal combustion engine according to another aspect of the invention includes the above-described variable compression ratio mechanism, and may be constructed so that a position of a bore wall surface lower end that is a crankcase-side end of the bore wall surface of the cylinder block is a position that is the same as a position of a block outer wall surface lower end that is a crankcase-side end of the outer wall surface of the cylinder block in which the block-side force-receiving portion extends out, or a position that is at a cylinder head side of the position of the block outer wall surface lower end.

Therefore, the distance of the movement of the bore wall surface lower end in an inward direction of the cylinder block caused when, of the crankcase-side end portion of the cylinder block (block lower end portion), a portion that includes the bore wall surface is bent in an inward direction of the cylinder block can be made shorter than in the case where the bore wall surface lower end is positioned at the crankcase side of the block outer wall surface lower end. As a result, the degree of the deformation of the bore wall surface caused by the pressing force can be made small.

Furthermore, a variable compression ratio internal combustion engine according to still another aspect of the invention includes: a cylinder block having a plurality of cylindrical cylinder bores that are cylindrical holes extending through the cylinder block in a predetermined bore center axis direction, and that are disposed in line in a cylinder arrangement direction that is orthogonal to the bore center axis direction, and that each house a piston; a cylinder head fixed to the cylinder block so as to cover one of opening portions of each cylinder bore; a crankcase that is disposed at a side of the cylinder block opposite from the cylinder head, and that is movable relative to the cylinder block in the bore center axis direction, and that rotatably supports a crankshaft that is linked to the piston; and a variable compression ratio mechanism that changes a capacity of a combustion chamber of each cylinder bore that is defined by a bore wall surface that defines the cylinder bore, a head lower surface that is a cylinder block-side surface of the cylinder head, and a piston top surface that is a head lower surface-side surface of the piston.

The variable compression ratio mechanism includes a block-side force-receiving portion extending outward from an outer wall surface of the cylinder block in a region in the outer wall surface that includes a portion of a line of intersection between the outer wall surface of the cylinder block and a plane that is orthogonal to the cylinder arrangement direction and that passes through a center axis of one of the cylinder bores, and a linkage portion that contacts each of the block-side force-receiving portion and the crankcase, and that changes a distance between the block-side force-receiving portion and the crankcase in the bore center axis direction.

In the variable compression ratio internal combustion engine in accordance with this aspect, the cylinder block may include a portion in which a distance between a bore center axes-arrangement plane that contains the cylinder arrangement direction and the bore center axis direction, and the outer wall surface of the cylinder block in a section of the cylinder block taken on a plane orthogonal to the cylinder arrangement direction is shorter than a distance between the bore center axes-arrangement plane and the outer wall surface at a position at which the block-side force-receiving portion extends out in a section of the cylinder block taken on a plane that is orthogonal to the cylinder arrangement direction and that passes through the block-side force-receiving portion.

That is, this cylinder block has a thick-walled portion that includes a portion in which the block-side force-receiving portion extends out, and a thin-walled portion made up of other portions. As a result, the rigidity of the cylinder block at the position where the block-side force-receiving portion extends out is higher than the rigidity thereof at other positions. Therefore, although the aforementioned pressing force is exerted on the cylinder block, the cylinder block is unlikely to deform. That is, it becomes possible to make small the degree of the deformation of the bore wall surface caused by the pressing force while restraining the increase in the weight of the cylinder block.

BRIEF DESCRIPTION OF THE DRAWINGS

The foregoing and further objects, features and advantages of the invention will become apparent from the following description of preferred embodiments with reference to the accompanying drawings, wherein like numerals are used to represent like elements and wherein.

DETAILED DESCRIPTION OF THE EMBODIMENTS

First Embodiment

Figure 1:
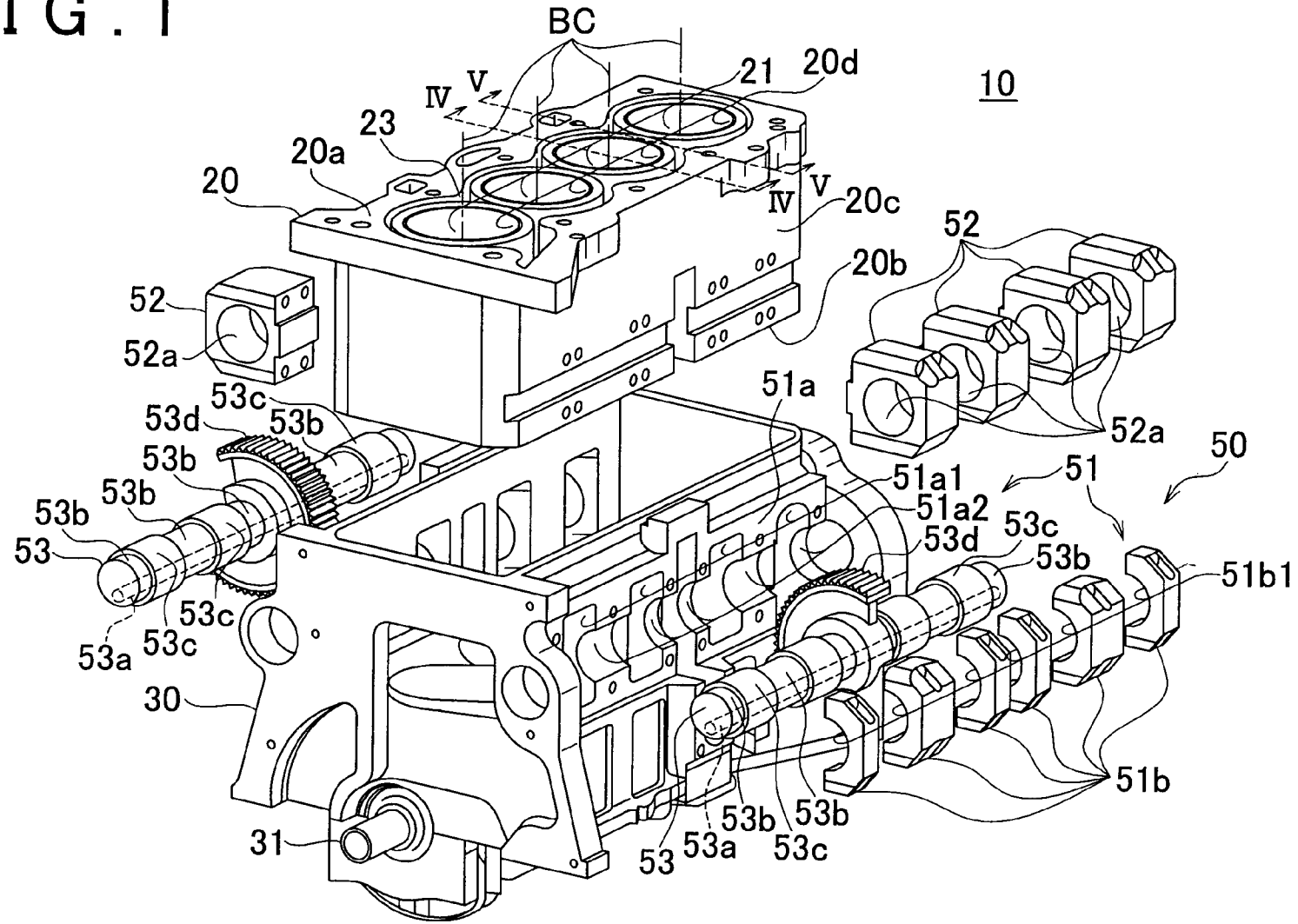
FIG. 1 is a schematic perspective view of a variable compression ratio internal combustion engine in accordance with a first embodiment of the invention.

Hereinafter, embodiments of the variable compression ratio internal combustion engine of the invention will be described with reference to the drawings. As shown in FIG. 1, a variable compression ratio internal combustion engine 10 includes a cylinder block 20 and a crankcase 30.

Cylinder Block

Figure 2:
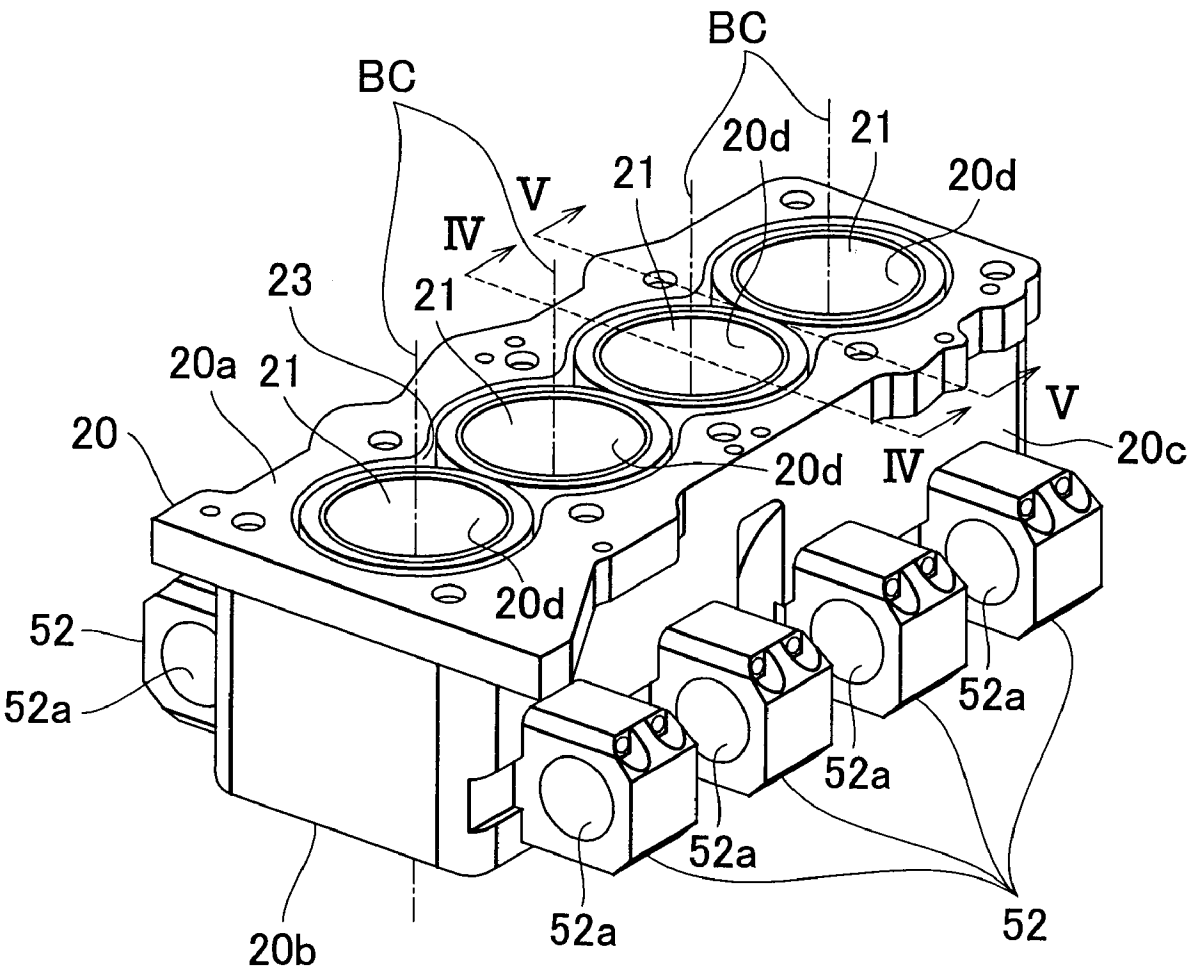
FIG. 2 is a perspective view of a cylinder block shown in FIG. 1, viewed from above.
Figure 3:
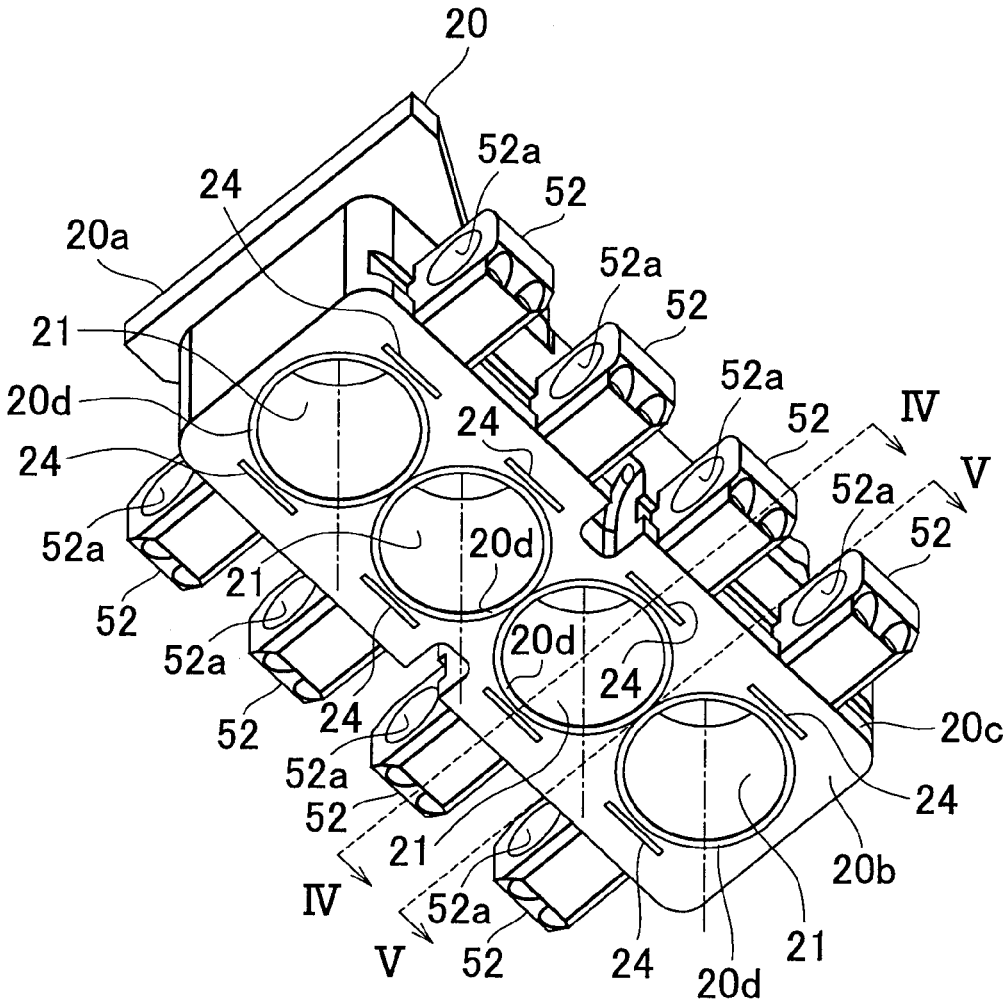
FIG. 3 is a perspective view of the cylinder block shown in FIG. 1, viewed from below.

The cylinder block 20 is made of aluminum. As shown in FIGS. 1 to 3, the cylinder block 20 has a generally rectangular parallelepiped shape having an upper surface 20*a* and a lower surface 20*b* that are of a generally rectangle shape having short sides and long sides, and side surfaces (in this specification, also referred to as "outer wall surfaces") 20*c* that are parallel to the direction of the long sides of the upper and lower surfaces 20*a*, 20*b*. Hereinafter in the specification, the direction from the upper surface 20*a* toward the lower surface 20*b* of the cylinder block 20 will be referred to as the downward direction, and the direction from the lower surface 20*b* toward the upper surface 20*a* of the cylinder block 20 will be referred to as the upward direction.

The cylinder block 20 has four cylindrical penetration holes that extend through the cylinder block 20 in a direction orthogonal to the upper surface 20*a* and the lower surface 20*b* (i.e., in the up-down direction, which will be also referred to as the bore center axis direction). These penetration holes are disposed in line in the long-side direction of the cylinder block 20 (cylinder arrangement direction). In each penetration hole, a hollow cylindrical cylinder liner 20*d* having an outside diameter that is equal to the diameter of the penetration hole is disposed coaxially with the penetration hole (pressed therein, or cast therein).

Each cylinder liner 20*d* is made of cast iron. A cylindrical space defined by an inner wall surface of the cylinder liner 20*d* is referred to as the cylinder bore 21. A lower end (crankcase 30-side end) of the cylinder liner 20*d* is contained in a plane that contains the lower surface 20*b* of the cylinder block 20. That is, the position, in the up-down direction, of the lower end (the bore wall surface lower end) of the inner wall surface of the cylinder liner 20*d* (a wall surface that defines the cylinder bore 21, i.e., a bore wall surface) is the same as the position, in the up-down direction, of the lower end of the outer wall surfaces 20*c* of the cylinder block 20 (the block outer wall surface lower end).

Figure 4:
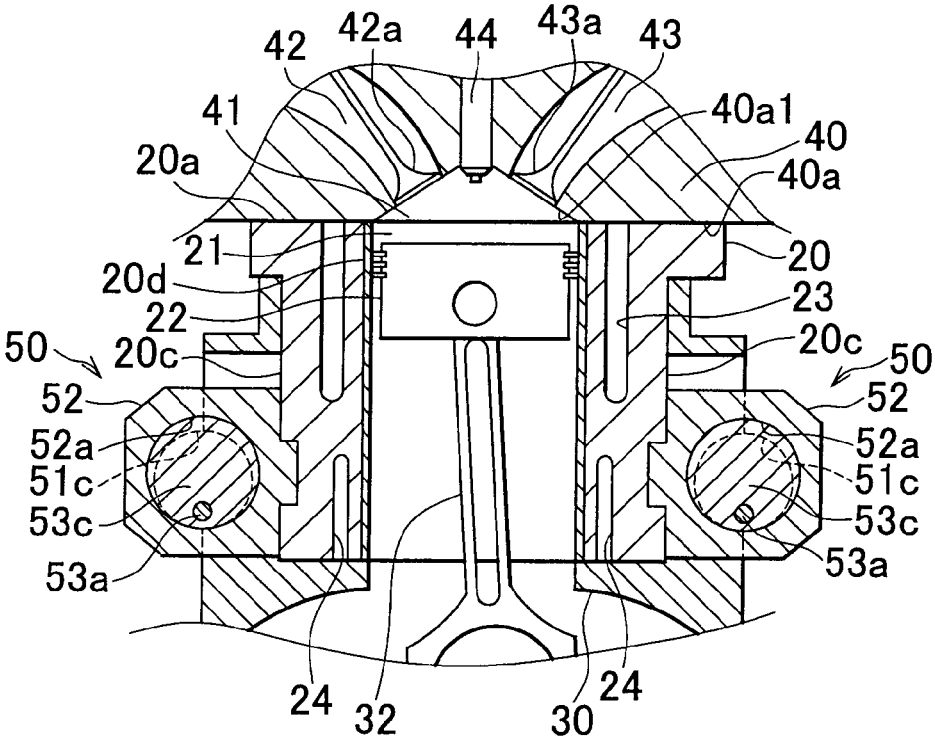
FIG. 4 is a sectional view of the variable compression ratio internal combustion engine taken on a plane represented by line IV-IV of FIG. 1.

The bore wall surface is designed to be supplied with lubricating oil from an oil pan (not shown) that is mounted to a lower portion of the crankcase 30. A sectional view of the variable compression ratio internal combustion engine 10 taken on a plane that passes through the center axis (bore center axis) BC of one of the cylinder bores 21 in FIG. 1 and that contains line IV-IV of FIG. 1, and that is orthogonal to the cylinder arrangement direction is shown in FIG. 4. Referring to FIG. 4, a cylindrical piston 22 is housed in each cylinder bore 21. A side surface of the piston 22 is provided with piston rings for scraping off excess lubricating oil from the bore wall surface.

A cooling water passageway 23 for cooling water is formed in the cylinder block 20. The cooling water passageway 23 is a groove arranged around the cylinder liners 20*d*, and has openings to the upper surface 20*a* of the cylinder block 20.

Crankcase

As shown in FIG. 1, the crankcase 30 rotatably supports a crankshaft 31, and also houses the crankshaft 31. The crankcase 30 is disposed below the cylinder block 20 so that the direction of the axis of the crankshaft 31 coincides with the cylinder arrangement direction. Each piston 22 is linked to the crankshaft 31 via a connecting rod 32 as shown in FIG. 4. Due to this construction, the reciprocating motion of each piston 22 is converted into rotating motion of the crankshaft 31.

Cylinder Head

Figure 5:
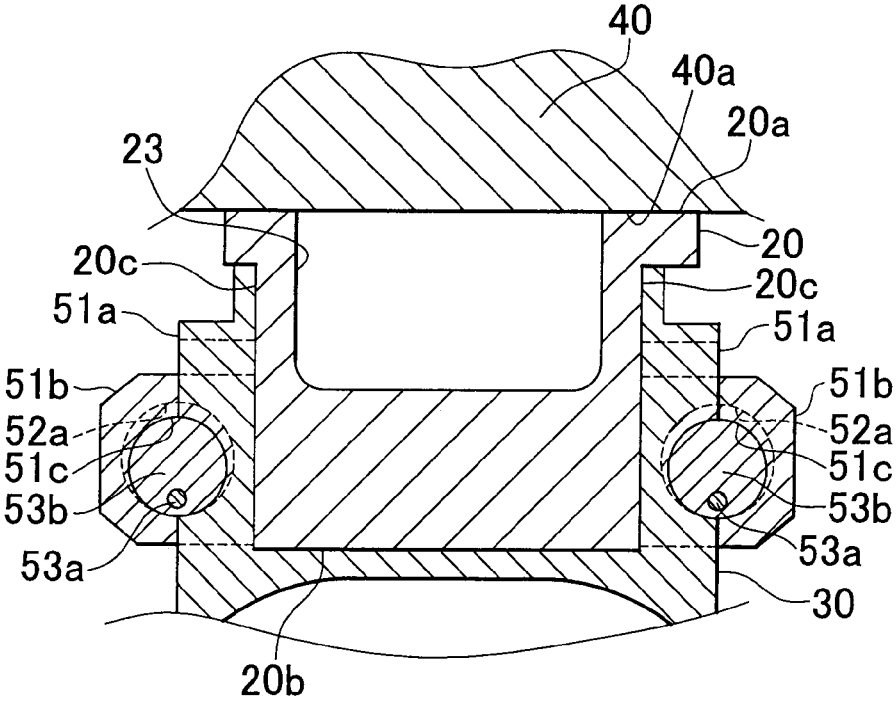
FIG. 5 is a sectional view of the variable compression ratio internal combustion engine taken on a plane represented by line V-V of FIG. 1.

A sectional view of the variable compression ratio internal combustion engine 10 taken on a plane that contains line V-V passing between cylinder bores 21 in FIG. 1 and that is orthogonal to the cylinder arrangement direction is shown in FIG. 5. As shown in FIG. 5, the variable compression ratio internal combustion engine 10 includes a cylinder head 40. The cylinder head 40 is fixed to the upper surface 20*a* of the cylinder block 20 (i.e., a side of the cylinder block 20 opposite from the crankcase 30) so as not to move relative to the cylinder block 20.

As shown in FIG. 4, the cylinder head 40 has a plurality of recess portions 40*a*1 that are open at a cylinder block 20-side surface of the cylinder head 40 (head lower surface) and that correspond one-to-one to the cylinder bores 21. When the cylinder head 40 is fixed to the cylinder block 20, each recess portion 40*a*1 becomes contiguous with the wall surface of a corresponding one of the cylinder bores 21 (bore wall surface). That is, the cylinder head 40 is fixed to the cylinder block 20 so as to cover one of the opening portions (the upper-side opening portion) of each cylinder bore 21. A combustion chamber 41 of each cylinder bore 21 (each cylinder) is defined by the bore wall surface, the cylinder head 40-side surface of the piston 22 (piston top surface), and a corresponding one of the recess portions 40*a*1 of the cylinder head.

In the cylinder head 40, intake ports 42 communicating with the combustion chambers 41 and exhaust ports 43 also communicating with the combustion chambers 41 are formed for the individual cylinders as shown in FIG. 4. Furthermore, in the cylinder head 40, intake valves 42*a* that open and close the intake ports 42 and exhaust valves 43*a* that open and close the exhaust ports 43 as well as ignition plugs 44 that generate sparks in the combustion chambers 41 are disposed for the individual cylinders.

In addition, the variable compression ratio internal combustion engine 10 includes a fuel injection device (not shown). By injecting fuel via the fuel injection device, a mixture gas containing fuel and air is supplied into the combustion chambers 41 through the intake ports 42.

Variable Compression Ratio Mechanism

The variable compression ratio internal combustion engine 10 further includes variable compression ratio mechanisms 50 as shown in FIGS. 1 to 5. The variable compression ratio mechanisms 50 are provided near both side surfaces (outer wall surfaces) of the cylinder block 20, that is, one at either side. The variable compression ratio mechanism 50 at one of the two outer wall surfaces 20*c* and the variable compression ratio mechanism 50 at the other outer wall surface 20*c* are symmetrical to each other with respect to a plane that contains the bore center axes BC of all the cylinders (hereinafter, referred to as "bore center axes-arrangement plane"). Therefore, only the variable compression ratio mechanism 50 of one of the side surfaces 20*c* will be described.

The variable compression ratio mechanism 50 includes a case-side bearing-forming portion 51, a block-side bearing-forming portion 52, and a shaft-shaped drive portion 53. Incidentally, the case-side bearing-forming portion 51 may be also termed the case-side force-receiving portion. The block-side bearing-forming portion 52 may be also termed the block-side force-receiving portion. The shaft-shaped drive portion 53 may serve as a linkage portion.

Case-Side Bearing-Forming Portion

The case-side bearing-forming portion 51 is made up of a flat plate-shaped vertical wall portion 51*a*, and a plurality of cap portions 51*b*. The vertical wall portion 51*a* constitutes an upper wall surface of the crankcase 30. The vertical wall portion 51*a* is formed so that, when the cylinder block 20 is disposed on the crankcase 30, the vertical wall portion 51*a* faces the side surface (outer wall surface) 20*c* of the cylinder block 20 and covers a portion of the outer wall surface 20*c*.

The vertical wall portion 51*a* has plural (four in this example) penetration holes 51*a*1 that extend through the crankcase from the outside to the inside and that correspond one-to-one to the cylinder bores 21 when the cylinder block 20 is disposed on the crankcase 30. Each of the penetration holes 51*a*1 is disposed in a region that contains a position at which the vertical wall portion 51*a* intersects with a plane that contains the center axis (bore center axis) BC of a corresponding one of the cylinder bores 21 and that is orthogonal to the cylinder arrangement direction. Recess portions 51*a*2 are formed between the penetration holes 51*a*1. Each recess portion 51*a*2 is opened toward outward, and has a semicircular shape in a section of the vertical wall portion 51*a* taken on a plane orthogonal to the cylinder arrangement direction. The semicircular centers of the recess portions 51*a*2 are on an axis.

The cap portions 51*b* correspond one-to-one to the recess portions 51*a*2 of the vertical wall portion 51*a*. Each of the cap portions 51*b* is fixed to the vertical wall portion 51*a* so as to cover a corresponding one of the recess portions 51*a*2. Each cap portion 51*b* has a recess portion 51*b*1 that is open toward the vertical wall portion 51*a* when the cap portion 51*b* is fixed to the vertical wall portion 51*a*, and that has a semicircular shape in a section of the cap portion 51*b* taken on a plane orthogonal to the cylinder arrangement direction. The diameter of the semicircular shape of the recess portions 51*b*1 is the same as the diameter of the semicircular shape of the recess portions 51*a*2.

With this construction, when the cap portions 51*b* are fixed to the vertical wall portion 51*a*, the case-side bearing-forming portion 51 has a plurality of cylindrical bearing holes 51*c* that are defined by the recess portions 51*a*2 of the vertical wall portion 51*a* and the recess portions 51*b*1 of the cap portions 51*b*, and that extend through case-side bearing-forming portion 51 in the cylinder arrangement direction, and that are coaxial with each other.

Block-Side Bearing-Forming Portion

The block-side bearing-forming portion 52 is actually made up of plural (four in this example) members that correspond one-to-one to the penetration holes 51*a*1 of the vertical wall portion 51*a*. The block-side bearing-forming portions 52 are inserted through the penetration holes 51*a*1 of the vertical wall portion 51*a*, and are fixed to a lower end portion of the outer wall surface 20*c* of the cylinder block 20. That is, each block-side bearing-forming portion 52 is protruded outward from the outer wall surface 20*c* of the cylinder block 20, and is disposed in a region that contains a portion of the line of intersection between the outer wall surface 20*c* of the cylinder block 20 and a plane that contains the center axis of a corresponding one of the cylinder bores 21 and that is orthogonal to the cylinder arrangement direction.

The length of the block-side bearing-forming portions 52 in the up-down direction is shorter than the length of the penetration holes 51*a*1 of the vertical wall portion 51*a* in the up-down direction. This construction makes the block-side bearing-forming portions 52 movable within the corresponding penetration holes 51*a*1 of the vertical wall portion 51*a* in the up-down direction. That is, the crankcase 30 is movable relative to the cylinder block 20 in the up-down direction (the direction of the bore center axes).

Each block-side bearing-forming portion 52 has a cylindrical bearing hole 52*a* that extends therethrough in the cylinder arrangement direction. The bearing holes 52*a* of the block-side bearing-forming portions 52 are coaxial with each other. The diameter of the bearing holes 52*a* is larger than the diameter of the bearing holes 51*c* of the case-side bearing-forming portion 51.

Shaft-Shaped Drive Portion

As shown in FIGS. 1, 4 and 5, the shaft-shaped drive portion 53 includes a rod-like eccentric shaft portion 53*a*, a plurality of stationary cam portions 53*b* that correspond one-to-one to the bearing holes 51*c* of the case-side bearing-forming portion 51, a plurality of movable cam portions 53*c* that correspond one-to-one to the bearing holes 52*a* of the block-side bearing-forming portions 52, and a worm gear 53*d*.

Each stationary cam portion 53*b* is a cylindrical member having substantially the same diameter as the bearing holes 51*c* of the case-side bearing-forming portion 51. The length of each stationary cam portion 53*b* in the direction of the axis thereof is substantially the same as the axial length of a corresponding one of the bearing holes 51*c* of the case-side bearing-forming portion 51. Each stationary cam portion 53*b* has a cylindrical penetration hole that extends therethrough in the direction of the axis at a position that is deviated (eccentric) from the center axis of the stationary cam portion 53*b*, and that has substantially the same diameter as the eccentric shaft portion 53*a*.

Each movable cam portion 53*c* is a cylindrical member having substantially the same diameter as the bearing hole 52*a* of each block-side bearing-forming portion 52. The length of each movable cam portion 53*c* in the direction of the axis thereof is substantially the same as the length of the bearing hole 52*a* of a corresponding one of the block-side bearing-forming portions 52. Each movable cam portion 53*c* has a cylindrical penetration hole that extends therethrough in the direction of the axis at a position that is eccentric from the center axis of the movable cam portion 53*c*, and that has substantially the same diameter as the eccentric shaft portion 53*a*.

The stationary cam portions 53*b* and the movable cam portions 53*c* are disposed alternately with each other. The stationary cam portions 53*b* and the movable cam portions 53*c* are mounted on the eccentric shaft portion 53*a* by disposing the stationary cam portions 53*b* and the movable cam portions 53*c* so that their penetration holes are coaxial, and then inserting the eccentric shaft portion 53*a* through all the penetration holes. The stationary cam portions 53*b* and the eccentric shaft portion 53*a* have screw holes (not shown). The stationary cam portions 53*b* are fixed to the eccentric shaft portion 53*a* by screws (not shown) that are inserted through the screw holes so that the stationary cam portions 53*b* do not rotate relative to the eccentric shaft portion 53*a* and so that all the stationary cam portions 53*b* are coaxial with each other. On the other hand, the movable cam portions 53*c* are rotatable relative to the eccentric shaft portion 53*a*.

The worm gear 53*d* is fixed to one of the stationary cam portions 53*b* so that the worm gear 53*d* does not rotate relative to the eccentric shaft portion 53*a*, and is coaxial with the stationary cam portions 53*b*. The worm gear 53*d* meshes with an output portion of a motor (not shown) so as to be rotationally driven by the motor.

The shaft-shaped drive portion 53 is supported by the case-side bearing-forming portion 51 and the block-side bearing-forming portions 52 so that each stationary cam portion 53*b* is housed in a corresponding one of the bearing holes 51*c* of the case-side bearing-forming portion 51, and is rotatable within the bearing hole 51*c* while in contact with the wall surface that defines the bearing hole 51*c*, and so that each movable cam portion 53*c* is housed in a corresponding one of the bearing holes 52*a* of the block-side bearing-forming portions 52, and is rotatable within the bearing hole 52*a* while in contact with the wall surface that defines the bearing hole 52*a*.

Operation Principle of Variable Compression Ratio Mechanism

The change in the compression ratio with rotation of the worm gear 53*d* will be described with reference to FIGS. 6A to 6C.

Figure 6A:
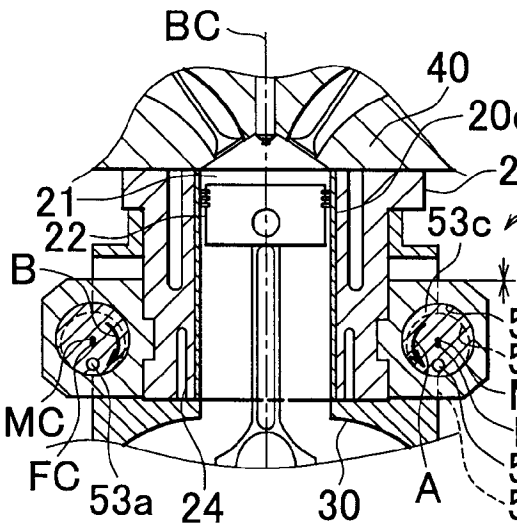
FIGS. 6A, 6B and 6C are diagrams schematically showing changes in the compression ratio caused by the driving of a variable compression ratio mechanism shown in FIG. 1.

As shown in FIG. 6A, when the center axis of the eccentric shaft portion 53*a* is right below the center axis FC of the stationary cam portions 53*b*, that is, when the center axis of the eccentric shaft portion 53*a* is at the lowest position relative to the center axis FC of the stationary cam portions 53*b*, the center axis of the eccentric shaft portion 53*a*, the center axis FC of the stationary cam portions 53*b* and the center axis MC of the movable cam portions 53*c* are aligned in that order on a straight line, and the distance between the center axis FC of the stationary cam portions 53*b* and the center axis MC of the movable cam portions 53*c* in the up-down direction is the shortest. Therefore, the distance between the crankcase 30 and the cylinder block 20 in the up-down direction is also the shortest, so that the compression ratio becomes the highest.

From this state, if the right-side worm gear 53*d*, in FIG. 6A, is rotationally driven counterclockwise (in the direction indicated by an arrow A) and the left-side worm gear 53*d* is rotationally driven clockwise (in the direction indicated by an arrow B), the center axis of the right-side eccentric shaft portion 53*a* moves counterclockwise about the center axis FC of the stationary cam portions 53*b*, and the center axis of the left-side eccentric shaft portion 53*a* moves clockwise about the center axis FC of the stationary cam portions 53*b*. It is to be noted herein that, due to the rigidity of the cylinder block 20, none of the movable cam portions 53*c* can be moved in the right-left direction.

Therefore, the right-side movable cam portions 53*c* rotate counterclockwise within the bearing holes 52*a* of the block-side bearing-forming portions 52 while in contact with the wall surfaces that respectively define the bearing holes 52*a*, and thus push up the block-side bearing-forming portions 52. The left-side movable cam portions 53*c* rotate clockwise within the bearing holes 52*a* of the block-side bearing-forming portions 52 while in contact with the wall surfaces that respectively define the bearing holes 52*a*, and thus push up the block-side bearing-forming portions 52. Then, if each worm gear 53*d* continues to be rotationally driven, the state of the variable compression ratio mechanisms 50 reaches a state as shown in FIG. 6B in which the center axis of the eccentric shaft portion 53*a* and the center axis FC of the stationary cam portions 53*b* are aligned in the left-right direction.

Figure 6B:
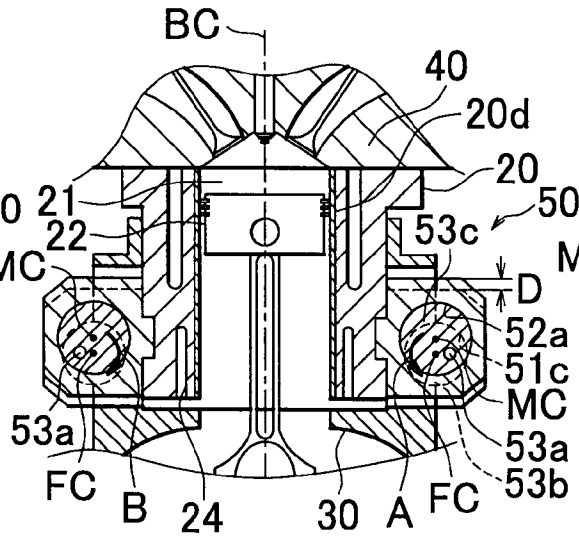

In the state shown in FIG. 6B, the distance between the center axis FC of the stationary cam portions 53*b* and the center axis MC of the movable cam portions 53*c* in the up-down direction is longer than in the state shown in FIG. 6A. Therefore, the distance between the cylinder block 20 and the crankcase 30 in the up-down direction is longer than in the case shown in FIG. 6A, so that the compression ratio becomes lower than in the case shown in FIG. 6A.

If each worm gear 53*d* further continues to be rotationally driven, the center axis of the right-side eccentric shaft portion 53*a* moves counterclockwise about the center axis FC of the stationary cam portions 53*b*, and the center axis of the left-side eccentric shaft portion 53*a* moves clockwise about the center axis FC of the stationary cam portions 53*b*. Due to this operation, the right-side movable cam portions 53*c* rotate clockwise within the bearing holes 52*a* of the block-side bearing-forming portions 52 while in contact with the wall surfaces that respectively define the bearing holes 52*a*, and thus push up the block-side bearing-forming portions 52. The left-side movable cam portions 53*c* rotate counterclockwise within the bearing holes 52*a* of the block-side bearing-forming portions 52 while in contact with the wall surfaces that respectively define the bearing holes 52*a*, and thus push up the block-side bearing-forming portions 52. Then, the state of the variable compression ratio mechanisms 50 reaches a state shown in FIG. 6C.

In the state show in FIG. 6C, the center axis FC of the stationary cam portions 53*b*, the center axis of the eccentric shaft portion 53*a* and the center axis MC of the movable cam portions 53*c* are aligned in that order from below on a straight line, and the distance between the center axis FC of the stationary cam portions 53*b* and the center axis MC of the movable cam portions 53*c* in the up-down direction is the longest (i.e., is longer than in the state shown in FIG. 6A and in the state shown in FIG. 6B). Therefore, the distance between the crankcase 30 and the cylinder block 20 in the up-down direction is also the longest, so that the compression ratio becomes the lowest.

Figure 6C:
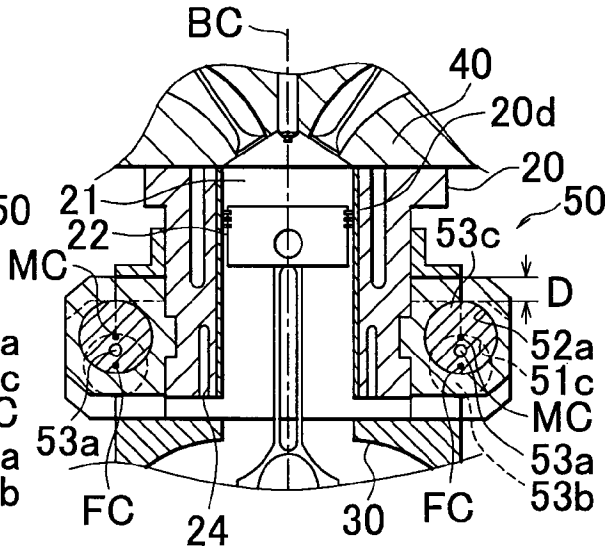

Thus, as the right-side worm gear 53*d* rotates counterclockwise and the left-side worm gear 53*d* rotates clockwise (as the state of the variable compression ratio mechanisms 50 shifts from the state shown in FIG. 6A toward the state shown in FIG. 6C), the compression ratio becomes lower.

If each worm gear 53*d* is rotated in the direction opposite to the aforementioned direction from the state shown in FIG. 6C, the compression ratio increases with the rotation of the worm gears 53*d* conversely to the aforementioned case. That is, if in the state shown in FIG. 6C the right-side worm gear 53*d* is rotationally driven clockwise and the left-side worm gear 53*d* is rotationally driven counterclockwise, the center axis of the right-side eccentric shaft portion 53*a* moves clockwise about the center axis FC of the stationary cam portions 53*b*, and the center axis of the left-side eccentric shaft portion 53*a* moves counterclockwise about the center axis FC of the stationary cam portions 53*b*.

Therefore, the right-side movable cam portions 53*c* rotate clockwise within the bearing holes 52*a* of the block-side bearing-forming portions 52 while in contact with the wall surfaces that respectively define the bearing holes 52*a*, and thus push down the block-side bearing-forming portions 52. The left-side movable cam portions 53*c* rotate counterclockwise within the bearing holes 52*a* of the block-side bearing-forming portions 52 while in contact with the wall surfaces that respectively define the bearing holes 52*a*, and thus push down the block-side bearing-forming portions 52.

Therefore, if the worm gears 53*d* continue to be rotationally driven, the state of the variable compression ratio mechanisms 50 reaches the state shown in FIG. 6B. If the rotational driving of the worm gears 53*d* is further continued, the state of the variable compression ratio mechanisms 50 reaches the state shown in FIG. 6A. Thus, as the right-side worm gear 53*d* rotates clockwise and the left-side worm gear 53*d* rotates counterclockwise (as the state of the variable compression ratio mechanism 50 shifts from the state shown in FIG. 6C toward the state shown in FIG. 6A), the distance between the crankcase 30 and the cylinder block 20 in the up-down direction becomes shorter, so that the compression ratio becomes higher.

By rotationally driving the worm gears 53*d* in the above-described manner, the distance between the crankcase 30 and the cylinder block 20 in the up-down direction (bore center axis direction) is changed, so that the compression ratio of the variable compression ratio internal combustion engine 10 is changed.

Slit-Shaped Groove

As shown in FIGS. 3 and 4, the cylinder block 20 has a plurality of slit-shaped stress reduction groove portions 24 as stress-reducing portions that correspond one-to-one to the block-side bearing-forming portions 52. In the lower surface 20*b* of the cylinder block 20, each stress reduction groove portion 24, when viewed from the bore center axis direction, has an opening at a position (in a region) between one of the block-side bearing-forming portions 52 that corresponds to the stress reduction groove portion 24 and the bore wall surface defining the cylinder bore 21 that is the nearest to the block-side bearing-forming portion 52. The shape of the opening of each stress reduction groove portion 24 is an elongated rectangular shape having long sides that are slightly longer than the length of each block-side bearing-forming portion 52 in the cylinder arrangement direction, and short sides that are orthogonal to the long sides and are very short.

The depth of each stress reduction groove portion 24 is slightly greater than half the length of the block-side bearing-forming portions 52 in the up-down direction as shown in FIG. 4.

Operation

In the variable compression ratio internal combustion engine 10 in accordance with the first embodiment constructed as described above, when a mixture gas formed in a combustion chamber 41 burns, the pressure of gas in the combustion chamber 41 becomes very high. Due to this pressure, the lower surface 40*a* of the cylinder head 40 is pressed upward by a force F0*a*, and the top surface of the piston 22 is pressed downward by a force F0*b*. Therefore, a force F1*a* in the upward direction is exerted on the cylinder block 20 to which the cylinder head 40 is fixed, and a force F1*b* in the downward direction is exerted on the crankcase 30 that supports the crankshaft 31 linked to the piston 22. As a result, crankcase 30-side portions of the wall surfaces that define the bearing holes 52*a* of the block-side bearing-forming portions 52 receive a force F2 caused by the shaft-shaped drive portion 53, and are therefore pressed downward.

Since the force F2 acts at a position that is apart outward from the outer wall surface 20*c* to which the block-side bearing-forming portions 52 are fixed, the force F2 acts on the cylinder block 20 as a force that tends to bend a lower end portion of the cylinder block 20 inward with respect to the cylinder block 20 (bending moment). In other words, a pressing force F3 in a direction toward the inside of the cylinder block 20 (pressing direction) is exerted on a crankcase 30-side end (block outer wall surface lower end, that is, a pressing position) of a region in the outer wall surface 20*c* of the cylinder block 20 to which region the block-side bearing-forming portions 52 are fixed. That is, the block-side bearing-forming portions (block-side force-receiving portions) 52 presses the outer wall surface 20*c* in the pressing direction, at a lower end portion of the outer wall surface 20*c* of the cylinder block 20.

Figure 7:
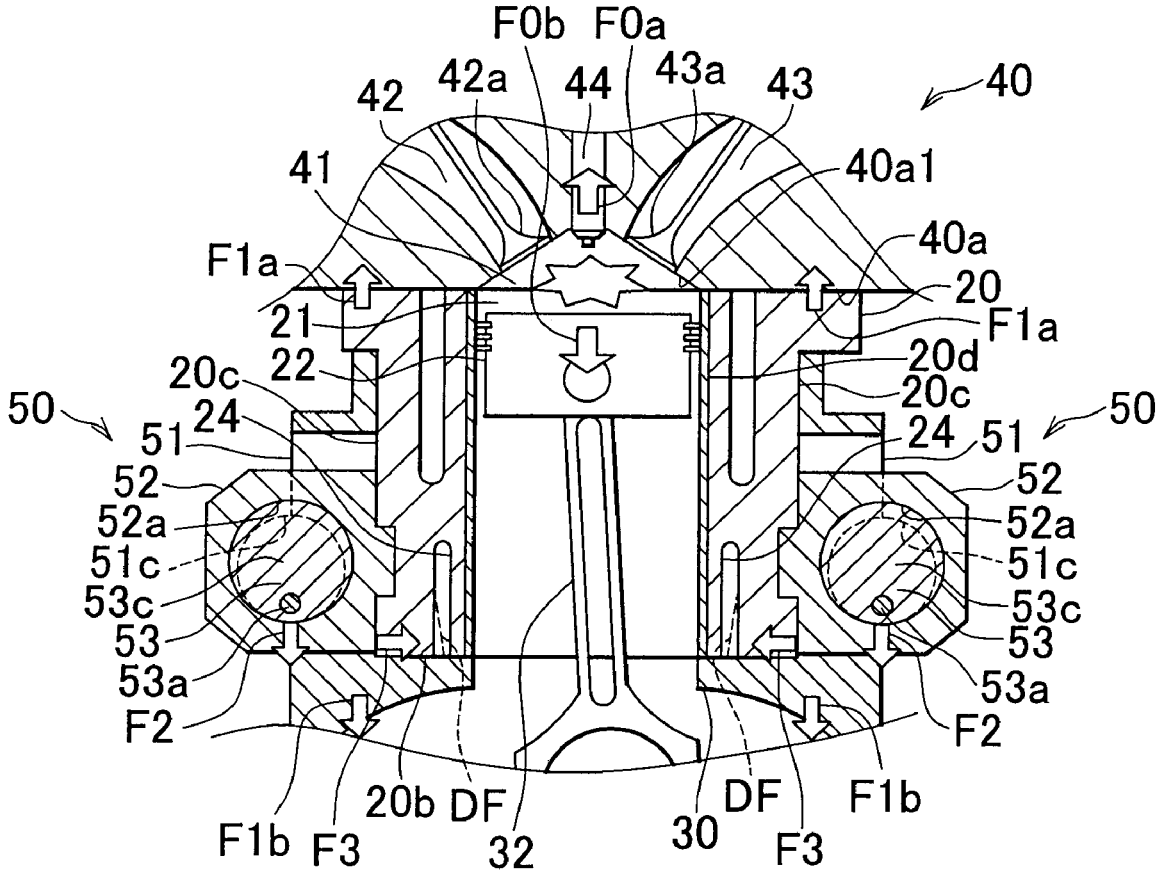
FIG. 7 is a diagram schematically showing the force that is exerted on the cylinder block when combustion occurs in a combustion chamber shown in FIG. 1, and the deformation of the cylinder block caused by the force.

Therefore, a stress having substantially the same magnitude as the stress occurring in the outer wall surface 20*c* at the aforementioned pressing position (outer wall surface stress) occurs in a portion (outer wall surface-side portion) of the cylinder block 20 that is on the outer wall surface 20*c* side of the stress reduction groove portions 24, so that the outer wall surface-side portion deforms as shown by dotted lines DF in FIG. 7. Therefore, the outer wall surface-side portion generates a force that opposes the force (pressing force) F3 by which the block-side bearing-forming portions 52 press the outer wall surface 20*c*.

As a result, the stress transmitted to the portion on the bore wall surface side of the stress reduction groove portions 24 (bore wall surface-side portion) becomes smaller than the outer wall surface stress. Therefore, of the stress caused in the cylinder block 20 by the aforementioned pressing force F3, the stress caused in the bore wall surface at a position of intersection between the bore wall surface and a pressing straight line that passes through the pressing position and that is parallel to the pressing direction (bore wall surface stress) is reduced, in comparison with the case where the stress reduction groove portions 24 are not formed. As a result, the degree of the deformation of the bore wall surface caused by the bore wall surface stress can be made small.

As a result, the friction force between the bore wall surfaces and the pistons 22 does not become excessively large, and deterioration in fuel economy can be prevented. Besides, since excess lubricating oil can be reliably scraped off by the piston rings, excessively large inflow of lubricating oil into the combustion chambers 41 can be prevented, and useless consumption of lubricating oil can be prevented.

Furthermore, according to the variable compression ratio internal combustion engine 10 of the first embodiment, the position, in the up-down direction, of the crankcase 30-side end of each bore wall surface (bore wall surface lower end) is the same as the position, in the up-down direction, of the crankcase 30-side end of the outer wall surface 20*c* of the cylinder block 20 from which the block-side bearing-forming portions 52 extend out (block outer wall surface lower end). Therefore, even if the bore wall surface-side portion of the crankcase 30-side end portion of the cylinder block 20 (block lower end portion) is bent inward with respect to the cylinder block 20 due to the pressing force F3 being very large, the distance of the inward movement of the bore wall surface lower end with respect to the cylinder block 20 can be made shorter than in the case where the bore wall surface lower end is positioned at the crankcase 30 side of the block outer wall surface lower end. As a result, the degree of the deformation of the bore wall surface caused by the pressing force F3 can be made small.

Besides, although in this embodiment, the position of the bore wall surface lower end in the up-down direction is the same as the position of the block outer wall surface lower end in the up-down direction, the bore wall surface lower end may also be positioned at the cylinder block side of (above) the block outer wall surface lower end. This construction also makes it possible to make small the degree of the deformation of the bore wall surface caused by the pressing force F3.

Modifications of the First Embodiment

Although in the first embodiment, the stress reduction groove portions are formed at positions apart from the cylinder liner 20*d*, the stress reduction groove portions may instead be formed so as to be adjacent to the cylinder liner 20*d*.

Figure 8:
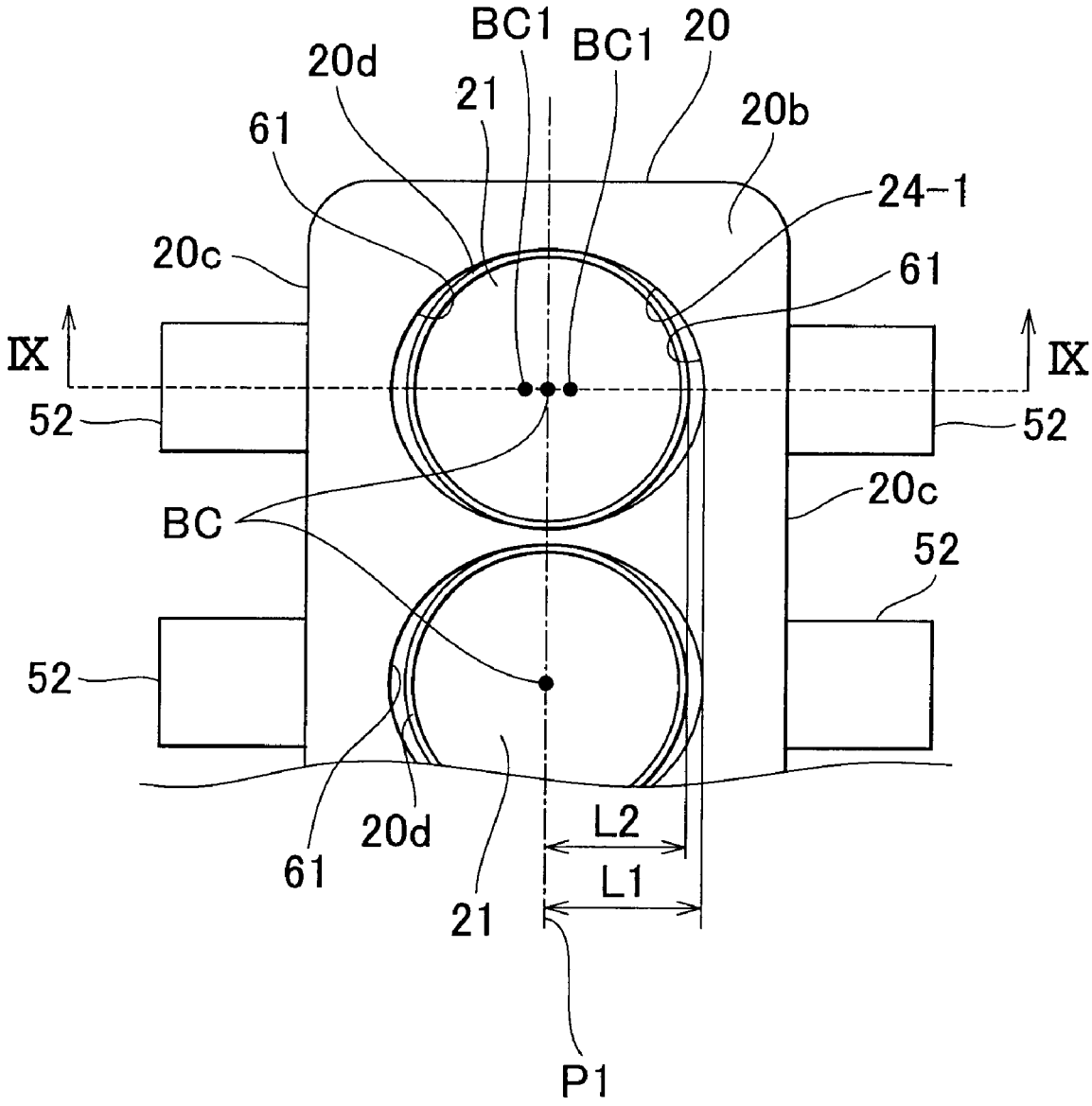
FIG. 8 is a schematic view of a cylinder block of a variable compression ratio internal combustion engine in accordance with a modification of the first embodiment of the invention, viewed from below.
Figure 9:
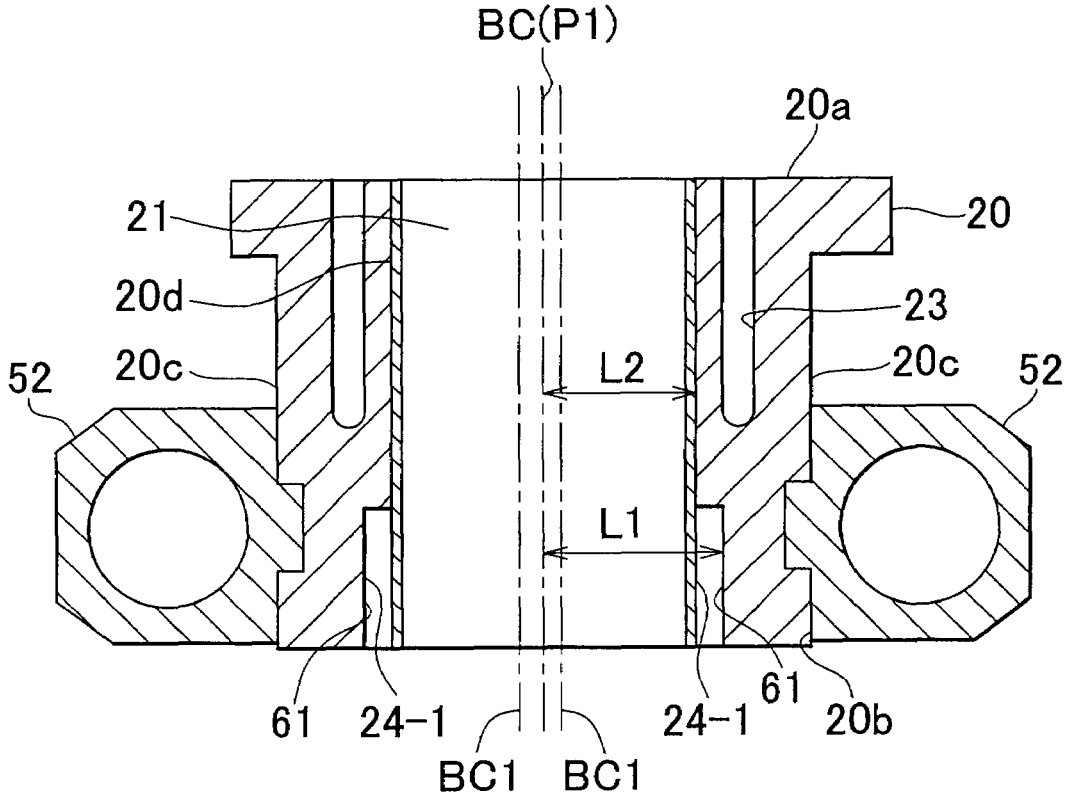
FIG. 9 is a sectional view of the cylinder block taken on a plane represented by line IX-IX of FIG. 8.

In this case, for example, as shown in FIG. 8, a diagram of the lower surface 20*b* of the cylinder block 20 viewed from below, and FIG. 9, a sectional view of the cylinder block 20 taken on a plane that contains IX-IX line of FIG. 8 and is orthogonal to the cylinder arrangement direction, a lower end portion of the wall surface of each of the penetration holes of the cylinder block 20 has a wider portion 61 in which the distance L1 measured from the bore center axes-arrangement plane P1 that contains the bore center axes BC of all the cylinders to the wall surface defining the penetration hole in the direction orthogonal to the bore center axes-arrangement plane P1 is longer than the distance L2 in an upper end portion of the wall surface of the penetration hole which is measured in the same manner as the distance L1.

The wider portion 61 of each of the penetration holes of the cylinder block 20 can easily be formed by cutting the wall surface of each penetration holes. After penetration holes identical to the cylindrical penetration holes formed in the cylinder block 20 in the first embodiment have been formed in a cylinder block 20, straight lines BC1, BC1 are set which are parallel to the bore center axis BC and which are a predetermined distance apart from the bore center axis BC in the direction orthogonal to the bore center axes-arrangement plane P1, and the wall surface of the penetration hole is cut in such a manner as to form a cylindrical hole about each of the two straight lines BC1, BC1 as a center axis. The wider portion 61 and the outer wall surface of the cylinder liner 20*d* of each cylinder form stress reduction groove portions 24-1. That is, this construction facilitates the formation of the stress reduction groove portions 24-1.

Figure 10:
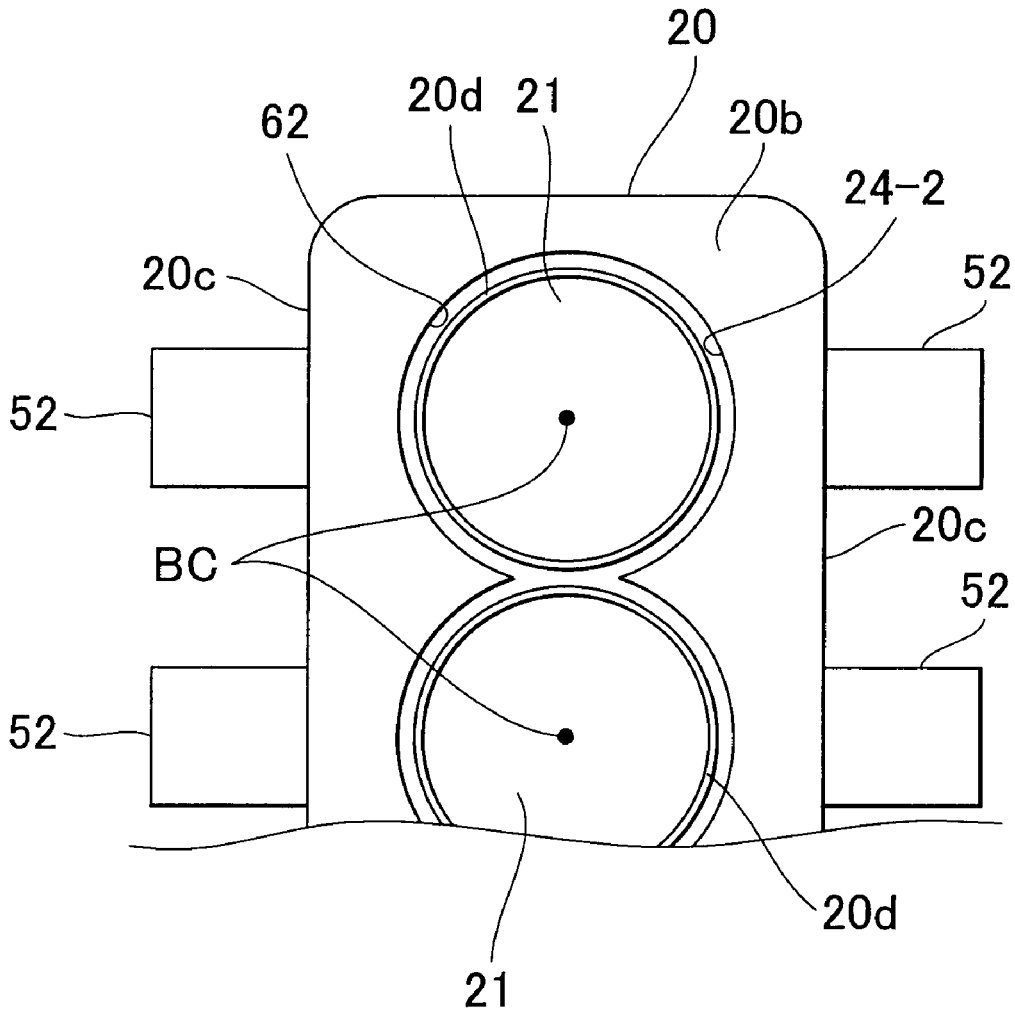
FIG. 10 is a schematic view of a cylinder block of a variable compression ratio internal combustion engine in accordance with another modification of the first embodiment of the invention, viewed from below.

The stress reduction groove portions may also be provided so as to surround the cylinder liners 20*d*. In this case, for example, as shown in FIG. 10, a diagram of the lower surface 20*b* of the cylinder block 20 viewed from below, a lower end portion of the wall surface that defines the penetration hole of each cylinder of the cylinder block 20 has a large-diameter portion 62 whose diameter is larger than the diameter of an upper end portion of the wall surface.

The large-diameter portion 62 of each cylinder can easily be formed in the following manner. After penetration holes identical to the cylindrical penetration holes formed in the cylinder block 20 in the first embodiment have been formed in a cylinder block 20, the wall surface of each penetration hole is cut in such a manner as to form a cylindrical hole that is coaxial with the bore center axis BC and that is larger in diameter than the penetration hole. The large-diameter portion 62 and the outer wall surface of the cylinder liner 20*d* of each cylinder form a stress reduction groove portions 24-2. This construction facilitates the formation of the stress reduction groove portion 24-2.

Furthermore, the stress reduction groove portions in the first embodiment and its modifications may be filled with an elastic material such as rubber or the like.

Second Embodiment

Next, a variable compression ratio internal combustion engine in accordance with a second embodiment of the invention will be described. The variable compression ratio internal combustion engine in accordance with the second embodiment is different from the variable compression ratio internal combustion engine 10 in accordance with the first embodiment only in having a reinforcement member as a stress-reducing portion in place of the stress reduction groove portions 24. The following description will be given mainly on this difference.

Figure 11:
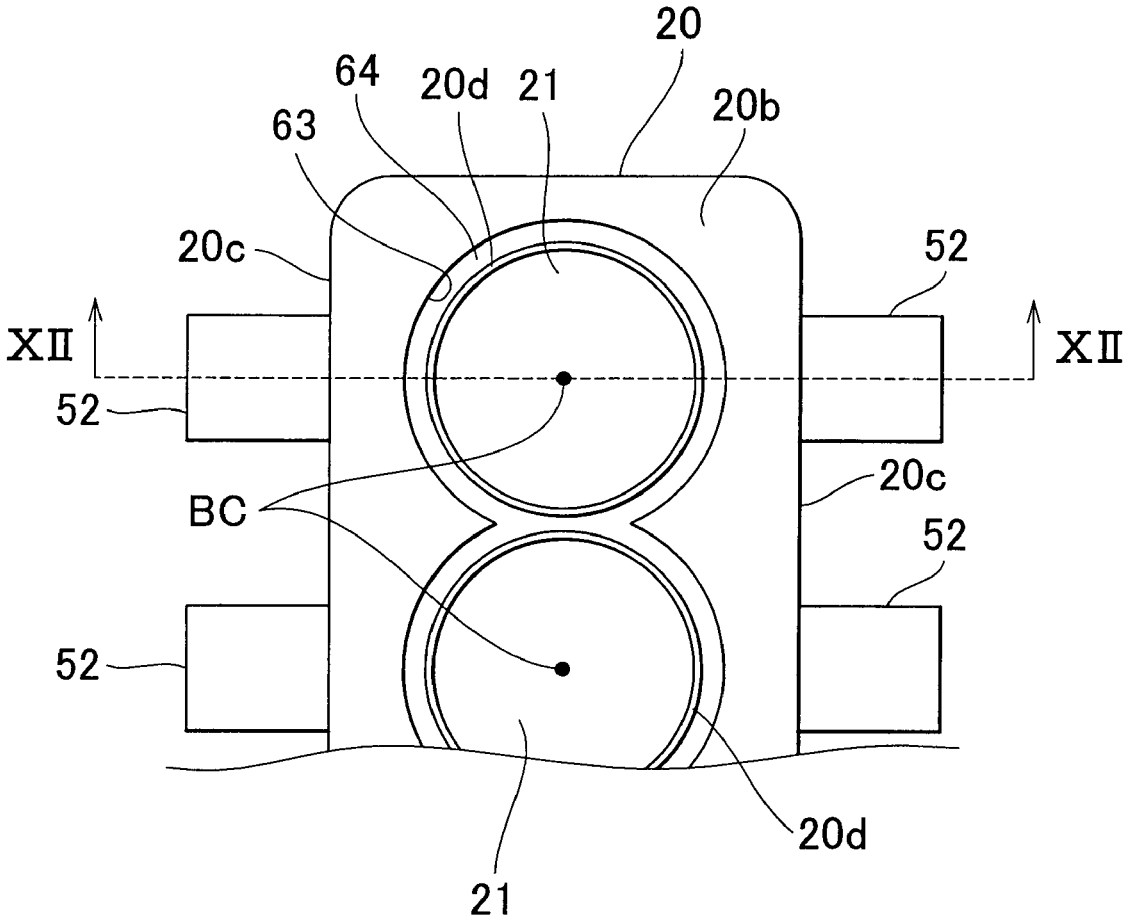
FIG. 11 is a schematic view of a cylinder block of a variable compression ratio internal combustion engine in accordance with a second embodiment of the invention, viewed from below.
Figure 12:
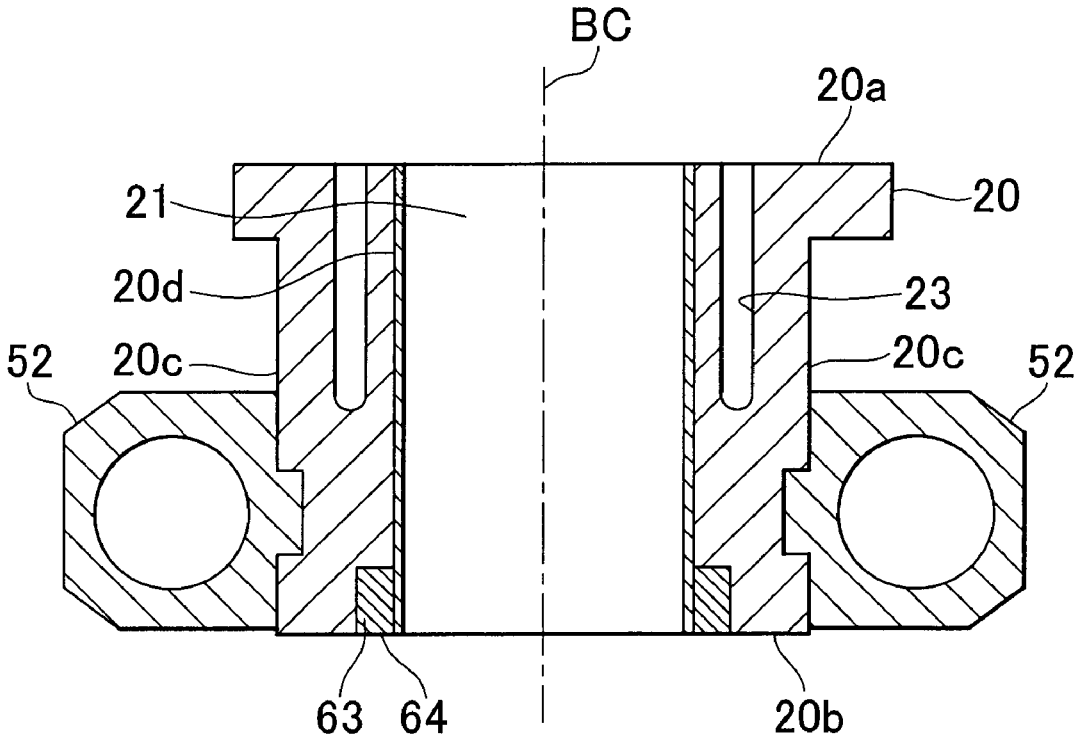
FIG. 12 is a sectional view of the cylinder block taken on a plane represented by line XII-XII of FIG. 11.

In the cylinder block 20 of the variable compression ratio internal combustion engine 10, as shown in FIG. 11, a diagram of the lower surface 20*b* of the cylinder block 20 viewed from below, and FIG. 12, a sectional view of the cylinder block 20 taken on a plane that contains XII-XII line of FIG. 11 and is orthogonal to the cylinder arrangement direction, a lower end portion of the wall surface of each of the penetration holes formed in the cylinder block 20 has a large-diameter portion 63 whose diameter is larger than the diameter of an upper portion of the wall surface.

In this embodiment, the length of the large-diameter portion 63 of each cylinder in the up-down direction (bore center axis direction) is substantially one third of the length of the block-side bearing-forming portions 52 in the up-down direction. However, the length of each large-diameter portion 63 in the up-down direction may also be a length ranging from about one quarter of the length of the block-side bearing-forming portions 52 in the up-down direction to the entire length of the block-side bearing-forming portions 52 in the up-down direction, and furthermore, may also be longer than the entire length of the block-side bearing-forming portions 52.

As for a space defined by the large-diameter portions 63 and the outer wall surfaces of the cylinder liners 20*d*, a reinforcement member 64 having the same shape as the space is pressed therein. That is, the reinforcement member 64 is disposed in the cylinder block 20 so as to extend through positions that are on the aforementioned pressing straight lines and that are between the block-side bearing-forming portions 52 and the cylinder liners 20*d* and so as to surround a periphery of the cylinder liners 20*d*. Moreover, the reinforcement member 64 is made of a material that has a higher rigidity than a portion of the cylinder block 20 excluding the cylinder liners 20*d* (a portion thereof made of aluminum in this example). (The material of the reinforcement member 64 is steel in this example, but may also be cast iron or the like.)

According to the variable compression ratio internal combustion engine 10 in accordance with the second embodiment constructed as described above, when the block-side bearing-forming portions 52 press the outer wall surface 20*c* of the cylinder block 20 as described above, a stress having substantially the same magnitude as the aforementioned outer wall surface stress occurs in a portion of the cylinder block 20 that is on the outer wall surface 20*c* side of the reinforcement member 64 (outer wall surface-side portion of the cylinder block 20). At this time, since the rigidity of the reinforcement member 64 is higher than the rigidity of the cylinder block 20, the rigidity of the reinforcement member 64 makes the stress transmitted to the portion of the cylinder block 20 on the bore wall surface side of the reinforcement member 64 (the bore wall surface-side portion, i.e., the cylinder liners 20*d*) smaller than the outer wall surface stress. Therefore, the bore wall surface stress becomes smaller than in the case where the reinforcement member 64 is not provided. As a result, the degree of the deformation of the bore wall surface caused by the bore wall surface stress can be made small.

Incidentally, the second embodiment may further include substantially the same stress reduction groove portions 24 as those provided in the first embodiment.

Third Embodiment

Next, a variable compression ratio internal combustion engine in accordance with a third embodiment of the invention will be described. The variable compression ratio internal combustion engine in accordance with the third embodiment is different from the variable compression ratio internal combustion engine 10 in accordance with the first embodiment only in that the stress reduction groove portions 24 are not formed and the cylinder block has a thick-walled portion and a thin-walled portion. The following description will be given mainly on these differences.

Figure 13:
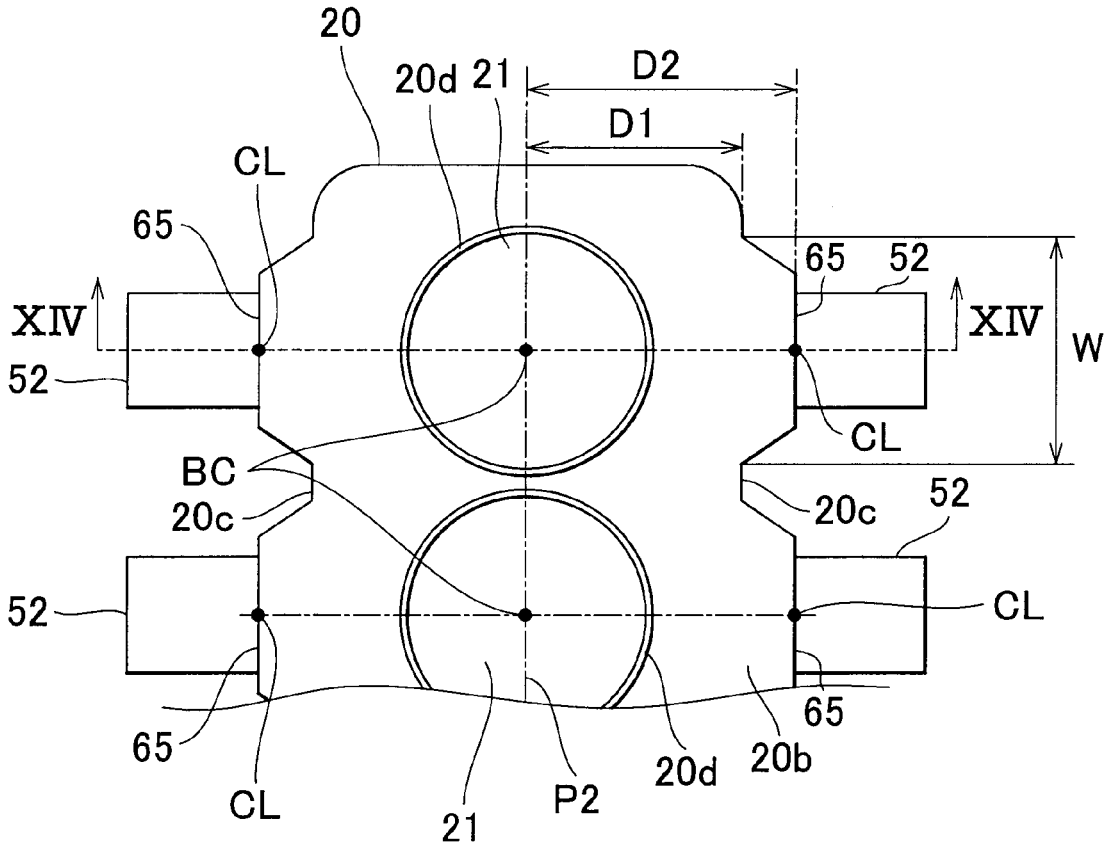
FIG. 13 is a schematic view of a cylinder block of a variable compression ratio internal combustion engine in accordance with a third embodiment of the invention, viewed from below.

In the outer wall surface 20*c* of the cylinder block 20 of the variable compression ratio internal combustion engine 10 of this embodiment, as shown in FIG. 13, a diagram of the lower surface 20*b* of the cylinder block 20 viewed from below, and FIG. 14, a sectional view of the cylinder block 20 taken on a plane that contains XIV-XIV line of FIG. 13 and is orthogonal to the cylinder arrangement direction, a plurality of protruded portions 65 that correspond to the individual cylinder bores 21 are formed.

A block-side bearing-forming portion 52-side top surface of each of the protruded portions 65 is a plane that is parallel to portions of the outer wall surface 20*c* in which a protruded portion 65 is not formed. Each protruded portion 65 is formed so that the top surface thereof intersects with a plane that contains the bore center axis BC of a corresponding one of the cylinder bores 21 and that is orthogonal to the cylinder arrangement direction. Furthermore, each protruded portion 65 is positioned on a lower end portion of the outer wall surface 20*c*. The top surface of each protruded portion 65 is constructed so that a block-side bearing-forming portion 52 can be fixed thereto.

That is, the block-side bearing-forming portions 52 extend out from the outer wall surface 20*c* (specifically, from the top surfaces of the protruded portions 65) of the cylinder block 20. Furthermore, each block-side bearing-forming portion 52 is disposed in a region that contains a portion of a line of intersection CL between the outer wall surface 20*c* of the cylinder block 20 and a plane which contains the bore center axis BC of one of the cylinder bores 21 that corresponds to the block-side bearing-forming portion 52 and which is orthogonal to the cylinder arrangement direction.

Due to this construction, the distance D1 between the outer wall surface 20*c* of the cylinder block 20 and the bore center axes-arrangement plane P2 containing the cylinder arrangement direction and the bore center axis direction which is measured in a section of the cylinder block 20 taken on a plane that is orthogonal to the cylinder arrangement direction and that passes through a portion of the outer wall surface 20*c* in which a protruded portion 25 is not formed is shorter than the distance D2 between the outer wall surface 20*c* of the cylinder block 20 and the bore center axes-arrangement plane P2 which is measured in a section of the cylinder block 20 taken on a plane that is orthogonal to the cylinder arrangement direction and that passes through a portion of the outer wall surface 20*c* in which a protruded portions 25 is formed.

Figure 14:
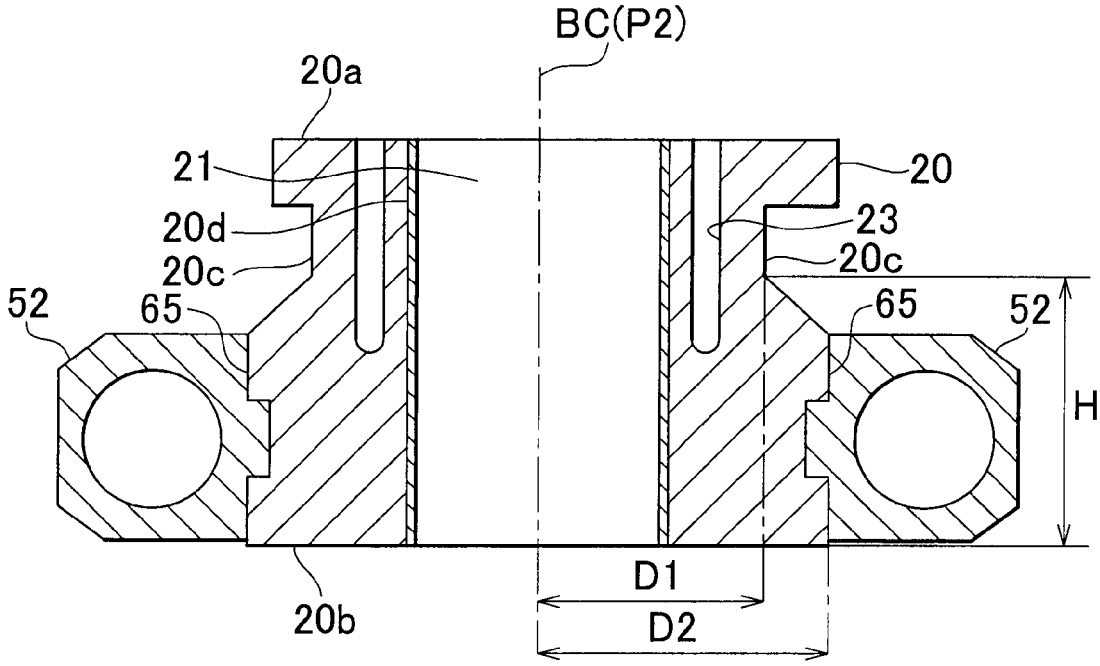
FIG. 14 is a sectional view of the cylinder block taken on a plane represented by line XIV-XIV of FIG. 13.

Furthermore, as shown n FIG. 14, this distance relationship also holds in the up-down direction of the cylinder block in a section of the cylinder block 20 taken on a plane that is orthogonal to the cylinder arrangement direction and that passes through a portion of the outer wall surface 20*c* in which a protruded portion 65 is formed. That is, in this section of the cylinder block 20, the distance D1 between the bore center axes-arrangement plane P2 and a portion of the outer wall surface 20*c* in which a protruded portion 65 is not formed is shorter than the distance D2 between the bore center axes-arrangement plane P2 and a portion of the outer wall surface 20*c* in which a protruded portion 65 is formed.

According to the foregoing construction, the cylinder block 20 includes portions in which the distance between the bore center axes-arrangement plane P2 and the outer wall surface 20*c* of the cylinder block 20 in a section of the cylinder block 20 taken on a plane orthogonal to the cylinder arrangement direction is shorter than the distance D2 between the bore center axes-arrangement plane P2 and the outer wall surface 20*c* at a position where a block-side bearing-forming portion 52 extends out (i.e., the top surface of a protruded portion 65) in a section of the cylinder block 20 taken on a plane that is orthogonal to the cylinder arrangement direction and that passes through block-side bearing-forming portions 52.

According to the variable compression ratio internal combustion engine 10 in accordance with the third embodiment constructed as described above, the cylinder block 20 has higher rigidity in the portions where a block-side bearing-forming portion 52 extends out than in other portions. Therefore, even when the pressing force F3 is exerted, the cylinder block 20 is unlikely to deform. That is, it becomes possible to make small the degree of the deformation of the bore wall surface caused by the pressing force F3 while restraining the increase in the weight of the cylinder block 20.

As described above, each of the variable compression ratio internal combustion engines according to the foregoing embodiments has a deformation-supressing structure. For example, the stress reduction groove portion, the structure of the cylinder block in which the position of the bore wall surface lower end is the same as the position of the block outer wall surface lower end, and the protruded portions formed on the outer wall surface of the cylinder block and corresponding to each cylinder bore may serve as the deformation-suppressing structure.

Incidentally, the invention is not limited to the foregoing embodiments or the like, but various modifications can be adopted within the scope of the invention. For example, the block-side bearing-forming portions 52 may also be formed integrally with the cylinder block 20. Furthermore, the block-side bearing-forming portions 52 may instead be disposed in a portion of the outer wall surface 20*c* that is above the crankcase 30-side end (lower end) of the outer wall surface 20*c*.

What is claimed is:

1. A variable compression ratio internal combustion engine comprising:

a cylinder block having a cylindrical cylinder bore that extends through the cylinder block in a predetermined bore center axis direction, and that houses a piston;

a cylinder head fixed to the cylinder block so as to cover one of opening portions of the cylinder bore;

a crankcase that is disposed at a side of the cylinder block opposite from the cylinder head, and that is movable relative to the cylinder block in the center axis direction of the cylinder bore, and that rotatably supports a crankshaft that is linked to the piston; and a variable compression ratio mechanism that changes a capacity of a combustion chamber defined by a bore wall surface that defines the cylinder bore, a head lower surface that is a cylinder block-side surface of the cylinder head, and a piston top surface that is a head lower surface-side surface of the piston, the variable compression ratio mechanism including a block-side force-receiving portion extending outward from an outer wall surface of the cylinder block, a first penetration hole disposed in a region on an upper wall surface of the crankcase that intersects with a plane that contains the bore center axis, the block-side force-receiving portion being moveable within the penetration hole in a vertical direction, and a linkage portion that changes a distance between the block-side force-receiving portion and the crankcase in the bore center axis direction while contacting each of the block-side force-receiving portion and the crankcase, wherein the cylinder block has a deformation-suppressing structure that restrains a deformation of the wall surface of the cylinder bore caused by a bore wall surface stress that occurs in the bore wall surface at a position of intersection between the bore wall surface and a pressing straight line that passes through a predetermined pressing position and that is a straight line parallel to a predetermined pressing direction as the block-side force-receiving portion receives by the linkage portion a force in a direction from the cylinder block toward the crankcase so that the block-side force-receiving portion presses the outer wall surface at the pressing position in the pressing direction, and wherein the variable compression ratio mechanism of the variable compression ratio internal combustion engine includes a second penetration hole located in an upper portion of the wall of the crankcase as a hole of an eccentric shaft of the crankcase, and the block-side force-receiving portion is rotatably driven in the hole of an eccentric shaft.

2. A variable compression ratio internal combustion engine according to claim 1, wherein the deformation-suppressing structure is made up of a stress-reducing portion that makes the bore wall surface stress smaller than an outer wall surface stress that occurs in the outer wall surface at the predetermined pressing position as the block-side force-receiving portion receives by the linkage portion a force in a direction from the cylinder block toward the crankcase so that the block-side force-receiving portion presses the outer wall surface at the pressing position in the pressing direction.

3. The variable compression ratio internal combustion engine according to claim 2, wherein the stress-reducing portion is made up of a slit-shaped groove portion that is formed in the cylinder block so as to have an opening at a position that is located between the block-side force-receiving portion and the bore wall surface in a crankcase-side surface of the cylinder block when the crankcase-side surface is viewed in the bore center axis direction.

4. The variable compression ratio internal combustion engine according to claim 2, wherein the cylinder block includes a hollow cylindrical cylinder liner that has an inner wall surface that constitutes the bore wall surface, and the stress-reducing portion is made up of a reinforcement member that has a higher rigidity than a portion of the cylinder block excluding the cylinder liner, and that is disposed in the cylinder block so as to extend through a position between the block-side force-receiving portion and the cylinder liner on a straight line that passes through the pressing position, and so as to extend around the cylinder liner in such a manner as to surround the cylinder bore about a center axis of the cylinder bore.

5. The variable compression ratio internal combustion engine according to claim 2, wherein the cylinder bore is formed by disposing a hollow cylindrical cylinder liner in a penetration hole that extends through the cylinder block, and the cylinder liner has an outside diameter that is equal to a diameter of the penetration hole, and the penetration hole has a wider portion in a portion of the penetration hole that is at a crankcase side and that corresponds to the block-side force-receiving portion, and in the wider portion, a distance from a center axis of the cylinder bore to a wall surface of the penetration hole is longer than in another portion of the penetration hole, and the stress-reducing portion is made up of a gap that is formed between the wider portion and the cylinder liner.

6. The variable compression ratio internal combustion engine according to claim 2, wherein the cylinder bore is formed by disposing a hollow cylindrical cylinder liner in a penetration hole that extends through the cylinder block, and the cylinder liner has an outside diameter that is equal to a diameter of the penetration hole, and the penetration hole has, in a crankcase-side portion of the penetration hole, an expanded-diameter portion whose diameter is larger than a diameter of another portion of the penetration hole, and the stress-reducing portion is made up of a gap that is formed between the expanded-diameter portion and the cylinder liner.

7. The variable compression ratio internal combustion engine according to claim 3, wherein the stress-reducing portion is formed by filling the slit-shaped groove portion with an elastic material.

8. The variable compression ratio internal combustion engine according to claim 1, wherein the deformation-suppressing structure is a structure that is formed by causing a position of a bore wall surface lower end that is a crankcase-side end of the bore wall surface of the cylinder block to be a position that is the same as a position of a block outer wall surface lower end that is a crankcase-side end of the outer wall surface of the cylinder block in which the block-side force-receiving portion extends out, or to be a position that is at a cylinder head side of the position of the block outer wall surface lower end.

9. The variable compression ratio internal combustion engine according to claim 1, wherein the stress-reducing portion is made up of a plurality of protruded portions that are formed on the outer wall surface of the cylinder block, and that correspond to each cylinder bore in a direction orthogonal to a cylinder arrangement direction.

10. A variable compression ratio internal combustion engine comprising:

a cylinder block having a cylindrical cylinder bore that extends through the cylinder block in a predetermined bore center axis direction, and that houses a piston;

a cylinder head fixed to the cylinder block so as to cover one of opening portions of the cylinder bore;

a crankcase that is disposed at a side of the cylinder block opposite from the cylinder head, and that is movable relative to the cylinder block in the bore center axis direction, and that rotatably supports a crankshaft that is linked to the piston; and a variable compression ratio mechanism that changes a capacity of a combustion chamber defined by a bore wall surface that defines the cylinder bore, a head lower surface that is a cylinder block-side surface of the cylinder head, and a piston top surface that is a head lower surface-side surface of the piston, the variable compression ratio mechanism including a block-side force-receiving portion extending outward from an outer wall surface of the cylinder block, a first penetration hole disposed in a region on an upper wall surface of the crankcase that intersects with a plane that contains the bore center axis, the block-side force-receiving portion being moveable within the penetration hole in a vertical direction, and a linkage portion that contacts each of the block-side force-receiving portion and the crankcase, and that changes a distance between the block-side force-receiving portion and the crankcase in the bore center axis direction, wherein the cylinder block is constructed so that a position of a bore wall surface lower end that is a crankcase-side end of the bore wall surface of the cylinder block is a position that is the same as a position of a block outer wall surface lower end that is a crankcase-side end of the outer wall surface of the cylinder block in which the block-side force-receiving portion extends out, or a position that is on a cylinder head side of the position of the block outer wall surface lower end, and wherein the variable compression ratio mechanism of the variable compression ratio internal combustion engine includes a second penetration hole located in an upper portion of the wall of the crankcase as a hole of an eccentric shaft of the crankcase, and the block-side force-receiving portion is rotatably driven in the hole of an eccentric shaft.

11. A variable compression ratio internal combustion engine according to claim 1, wherein a length of the block-side force-receiving portion in the vertical direction is less than a length of the penetration hole in the vertical direction.

* * * * *